US005277254A

United States Patent [19]

Rullman et al.

[11] Patent Number: 5,277,254

[45] Date of Patent: Jan. 11, 1994

[54] HELICAL ROD GUIDE

[76] Inventors: Paul B. Rullman, 205 Tumbleweed, Borger, Tex. 79007; Edward L. Olinger, 500 N. Hoyne, Fritch, Tex. 79036; H. Milton Hoff, 611 Hickory, Tomball, Tex. 77375

[21] Appl. No.: 997,160

[22] Filed: Dec. 23, 1992

Related U.S. Application Data

[63] Continuation of Ser. No. 677,198, Mar. 28, 1991.

[51] Int. Cl.[5] ..... E21B 17/10

[52] U.S. Cl. ..... 166/241.4

[58] Field of Search ..... 166/241.1, 241.2, 241.3, 166/241.4, 176, 53, 68, 311, 241.1-; 175/325.2; 138/89, 94; 277/102, 110; 417/456, 511

[56] References Cited

U.S. PATENT DOCUMENTS

| | | | |
|---|---|---|---|
| 1,633,843 | 6/1927 | Bostic | 166/176 |
| 1,891,615 | 12/1932 | Bostic | 166/176 |
| 2,772,741 | 12/1956 | Polson | 166/176 |
| 2,928,472 | 3/1960 | Tripplehorn | 166/176 |
| 3,044,552 | 7/1962 | Claiborne | 166/311 X |
| 3,083,772 | 4/1963 | Triplehorn . | |
| 3,282,344 | 11/1966 | Triplehorn . | |
| 3,329,212 | 7/1967 | Pourchot . | |
| 3,410,349 | 11/1968 | Troutman . | |
| 3,442,558 | 5/1969 | Sable . | |
| 3,516,494 | 6/1970 | Ward | 166/176 X |
| 4,088,185 | 5/1978 | Carson | 166/176 |
| 4,575,163 | 3/1986 | Sable | 166/241.4 X |
| 4,858,688 | 8/1989 | Edwards et al. | 166/241.4 |

OTHER PUBLICATIONS

Reamco Inc., Shrink-Fit Sleeve Stabilizer, Hevi-Wate Drillpipe "SuperPac" Stabilizers (4 pp).

Pacto MORT Scraper/Guide, LOTUS Rod Guides (2 pp).

*Primary Examiner*—Ramon S. Britts

*Assistant Examiner*—Roger L. Schoeppel

[57] ABSTRACT

A rod guide for use with a rotating progressing cavity pump rod string which minimizes the resistance offered thereby to the axial flow of well fluids. This rod guide decreases turbulence and thereby reduces internal abrasion of the rod and tubing wear together with energy demand. The helical guide may employ either one or two lead vanes.

26 Claims, 2 Drawing Sheets

HELICAL ROD GUIDE

This is a continuation of co-pending U.S. application Ser. No. 07/677,198 filed on Mar. 28, 1991.

BACKGROUND OF THE INVENTION

This application relates to improvements in rod guides or the like for rotating sucker rods and pumping oil wells and more particularly to rod guides having reduced drag resistance, turbulence and energy demand.

As is well known, sucker rods in pumping oil wells normally extend longitudinally through the well bore or tubing and are reciprocated or rotated therein during the pumping operation. Since most well bores are not straight, and many are purposely drilled at an angle, the rods frequently wear against or engage the walls of the tubing during reciprocation or rotation thereof, which creates detrimental wear on the rods, rod couplings and tubing.

One usual apparatus for pumping well fluids includes a pump connected to the lower end of the tubing which is reciprocated the string of sucker rods. The sucker rods, or rod string, are connected to a reciprocating mechanical lift for alternately pulling the string upward and then allowing the string to move downwardly by gravity.

An alternative apparatus for pumping well fluids includes a progressing cavity pump connected to the lower end of the tubing. A rotor is rotated within a stator of the pump by the string of sucker rods. The sucker rods, or rod string, are connected to a mechanical drive for rotating the string to raise the well fluids.

Since the rotation of the rod string provides the force necessary to move well fluids upwardly through the tubing, if the resistance to rotational movement of the string is excessive, energy is unnecessarily expended. Further, if the rotation of the rods induces large amounts of pressure drop, turbulence or resistance to flow at a point, this localized turbulence can promote excessive wear of the rod and tubing or even induce fracture.

Heretofore, conventional rod guides of the paddle type have been used to avoid unnecessary wear of the rod against the tubing. However, these paddle type rod guides induce excessive resistance to fluid flow and cause greater turbulence and considerable tubing wear where it is mounted on the rotating rod.

In order to avoid this problem, occasionally substantially solid rod guides are employed with progressing cavity pumps in wells. To reduce restriction of fluid flow, the solid guide must leave substantial clearance between the guide and the tubing wall which permits only a reduced erodible volume of material to protect the rod coupling.

SUMMARY OF THE INVENTION

This invention includes an improved sucker rod guide to be fixedly engaged about a sucker rod at a selected location along the length of a rod. The rod guide comprises a substantially cylindrical polymeric body, having a longitudinal axis, a radially inward surface and a radially outward surface. The radially inward surface of the body is adjacent to and in gripping engagement with the rod when the rod guide is fixedly engaged about the rod. Further, the invention contains a single substantially continuous helical vane carried by the body. The vane is disposed about the radially outward surface of the guide body and is axially displaced along a length of the guide body a selected flight distance sufficient for the vane to complete at least one revolution about the axis of the guide body. A revolution of the vane is separated by a selected pitch distance with the vane extending radially away from the guide body and having a radially outside wear surface. The vane has a maximum width at the wear surface between 30–60 percent of the selected pitch distance.

An alternative improved sucker rod guide for fixedly engaging about a sucker rod at a selected location along the length of the rod is disclosed. This rod guide comprises a substantially cylindrical polymeric body having a longitudinal axis, a radially inward surface and a radially outward surface. The radially inward surface of the body is adjacent to and in gripping engagement with the rod when the rod guide is fixedly engaged about the rod. Two substantially continuous helical vanes are carried by the body. Each vane is disposed about the radially outward surface of the guide body and axially displaced along the length of the guide body a selected flight distance sufficient for the vane to substantially complete between ½ and 3 revolutions about the axis of the guide body. A revolution of the vane is separated by a selected pitch distance with the vane extending radially away from the guide body and having a radially outside wear surface. The vane has a maximum width at the wear surface between 10–30 percent of the selected pitch distance.

It is an object of the present invention to provide a rod guide for rotating sucker rods of a rod string which will hold the rods in central longitudinal alignment in the tubing while presenting minimal resistance t the axial flow of fluids.

It is another object of the present invention to provide rod guides on the rods which decrease the resistance to fluid flow and turbulence and the internal abrasion of the rod and the excessive tubing wear.

It is yet another object of the present invention to provide a rod guide having a longer wear life with a greater erodible volume of material.

It is yet another object of the present invention to provide a rod guide with reduced resistance to upward flow past the rod guide without sacrificing the erodible volume available for wear.

These and other objects of this invention will become more apparent from the following description.

DETAILED DESCRIPTION

Figure 1:
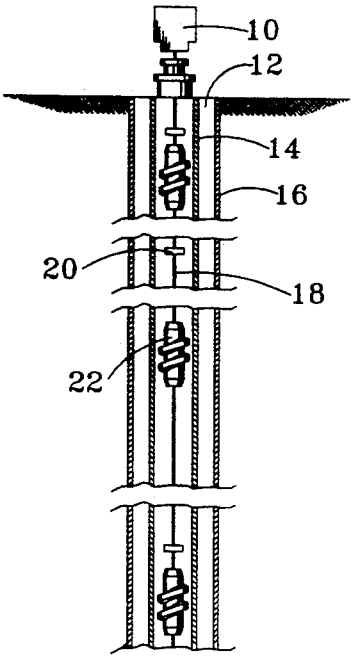
FIG. 1 is a vertical view of a well having a rotating rod string provided with rod guides of the present invention.

Referring now to the drawings, a motor apparatus (10) is shown in use pumping fluids from a well (12) through a string of tubing (14) disposed within well casing (16). Connected to the motor (10) is a string of sucker rods (8) which are connected together by typical box and socket couplings (20).

When the motor apparatus rotates the string of rods (18) within the tubing (14) it operates a progressing cavity pump (not shown). A plurality of rod guides (22) of the present invention are fixedly engaged around the sucker rods at selected locations throughout the length of the rod. During this rotational movement of the string of sucker rods, the well fluids are caused to flow upwardly in the tubing relative to the rod guides.

Figure 2A:
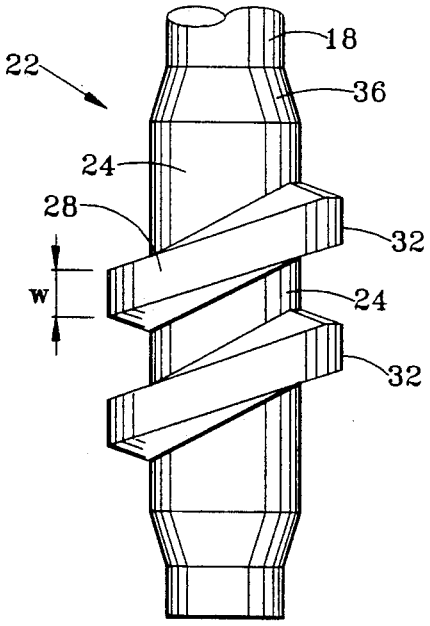
FIGS. 2*a* and 2*b* are side views of one embodiment of a rod guide of the present invention.
Figure 2B:
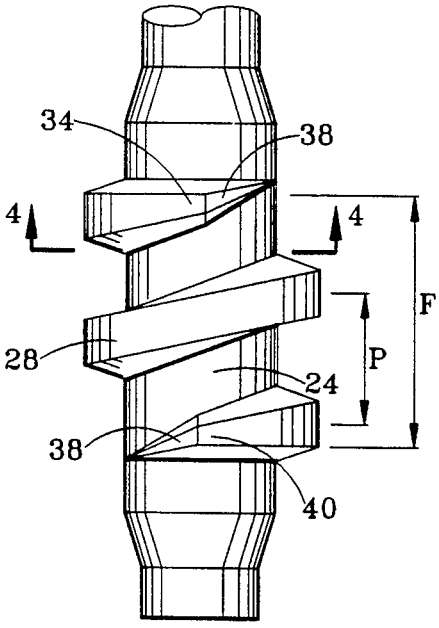

Referring now to FIGS. 2*a* and 2*b*, there may be seen a more detailed illustration of one embodiment of rod guide (22). This rod guide is typically composed of a polymer material molded about a selected location along rod (18). In the alternative, an axial slot may be provided for field installation. Although many polymeric materials are suitable, presently in common use are UHMW polyethylene, polyethylene, nylon, and polyphenyl sulfide.

This substantially longitudinal rod guide is substantially coaxial with the rod and has a substantially cylindrical polymeric body (24) molded about the rod which carries a single, substantially continuous helical vane (28) integrally molded with the body (24) and disposed about the radially outward surface of the guide body. This helical vane (28) extends substantially the entire length of the guide body and extends radially away from the guide body to provide a radially outside wear surface (32) for frictional engagement with the tubing (14) This helical vane is axially displaced along the length of the guide body a selected flight distance (F) sufficient for the vane to complete between about one and three revolutions about the axis of the guide body. If desired, the guide body may include a tapered end (36) for even lower resistance to fluid flow around the rod guide.

Figure 3:
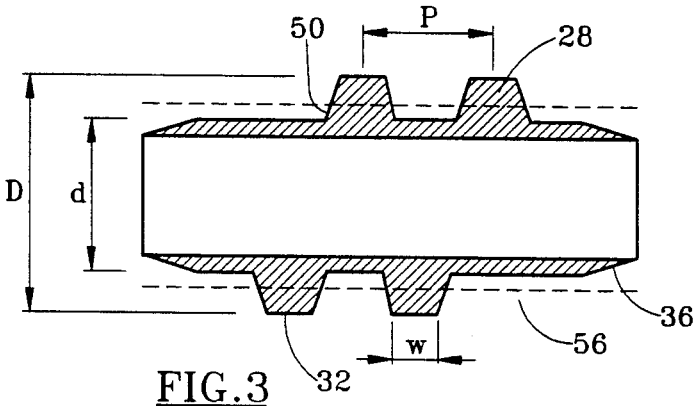
FIG. 3 is a cross-sectional view taken along line 3—3 of the rod guide of FIG. 2.

Referring now to FIG. 3, there may be seen a side view in cross-section of the guide of FIG. 2*a*. It may be seen that the helix formed by the vane has a selected pitch distance (P) and the vane, at its point of maximum thickness, has an axial thickness, or width (W). A selected pitch distance (P) between 1-2 inches is preferred, with 1.4-1.6 inches more preferred. Although it is preferred that the vane have a substantially equal width throughout its length, it may be desirable to have its thickness vary from its midpoint to the terminal ends of the vane.

Figure 4:
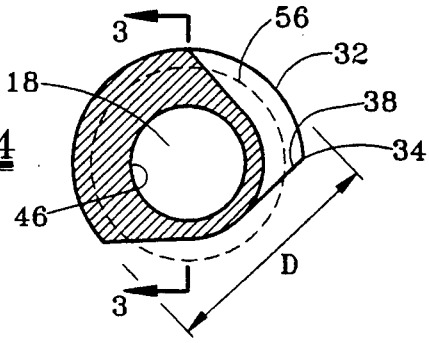
FIG. 4 is an end view in cross-section taken on line 4—4 of FIG. 2*a*.

Referring now to FIG. 4, there may be seen a cross-sectional view of the guide of FIGS. 2 and 3 along line 4—4. The rod guide is molded about the rod (18) and is fixedly engaged about the rod by the shrink fit of the polymer body about the rod at the inward surface (46) of the guide. Referring to FIGS. 3 and 4, the thickness of the guide body is determined by the outer diameter (d) of the guide body about the rod. For manufacturing convenience, it has been found desirable to allow the outer diameter of the body to remain substantially constant even though the diameter of the rod (18) may vary. Accordingly, the thickness of the body on the rod may vary from rod size to rod size.

It is a feature of the present invention that the maximum width (W) of the vane is maintained at a thickness which permits convenient passage of fluids about the guide yet provides adequate erodible volume for wear life. Accordingly, it has been found that a maximum width of the vane, measured axially at the wear surface, should be between 30-60 percent of the selected pitch distance if a single vane is used. A maximum width of 45-55% is more preferred. In practice a width of about 0.5 to 0.7 inches is acceptable for a pitch distance of 1½" used on a nominal 2½" guide. The flight (F) of the helical vane is preferred to be a selected distance sufficient for the vane to complete between one and three revolutions about the axis of the guide body, although between one and two revolutions is more preferred.

Referring to FIGS. 3 and 4, it may be seen that the wear surface (32) of the vane establishes a diameter (D). It may also be noted that the base portion (50) of the vane adjacent the rod body is wider than the vane at the outside wear surface. This feature permits manufacturing convenience.

It is a feature of the present invention to provide a rod guide having a reduced rotational drag force while at the same time not sacrificing erodible volume. Erodible volume is that volume of polymer on the guide which lies between the outer diameter (D) and the diameter (56) of the coupling to be protected. The diameter of the coupling (20) may vary depending upon the style of coupling and the diameter of the rod. Typically, a ⅝" rod is coupled with a coupling having an outer diameter of about 1.5 inches. A ¾" rod is coupled with a 1⅝" coupling, a ⅞" rod with a 1-13/16" coupling, and a 1" rod with a 2-3/16" coupling.

Another important concept is the by-pass area. This is that area between the guide body and the tubing wall which is available for the flow of fluid. Naturally, if the by-pass area is small, each rod guide serves as a restriction point, which unnecessarily increases the amount of energy required to pass fluids along the length of the tubing. It can be seen, therefore, that by-pass area and erodible volume may tend to oppose each other. Accordingly, the space between each revolution of the vane establishes a fluid passage way for axial flow of the well fluid along the tubing string when the rod string is rotated. Naturally, the direction of the spiral of the vane should be selected based upon the direction of rotation of the rod and the desired axial flow of the well fluids. Conventionally the rod is rotated clockwise when viewed from the top. In this case the helix of the rod guide should have a right hand lead or thread.

Referring now to FIGS. 2*a* and 4, it may be seen that at each end of the substantially continuous vane there is a brief transition portion (38) as the vane extends radially away from the guide body to wear surface (32). For convenience, it has been elected to define the flight distance (F) to be the axial distance from the beginning (34) of wear surface (32) to the end (40) of wear surface (32). Likewise, the pitch distance (P) is defined as the axial distance required for the midline of the vane to make a single revolution about the axis.

Figure 5:
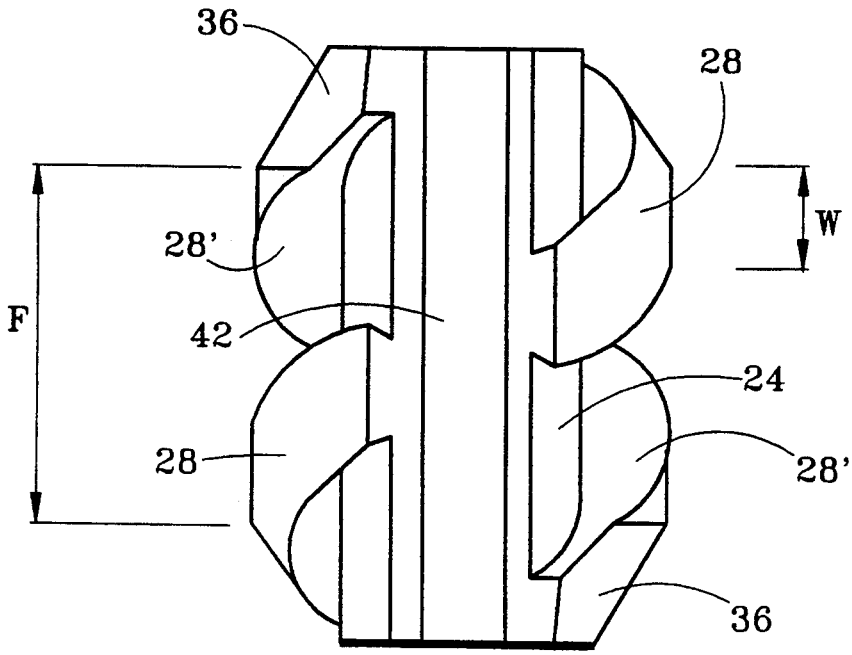
FIG. 5 is a side view of another embodiment of the rod guide of the present invention having two vanes and adapted for field installation.
Figure 6:
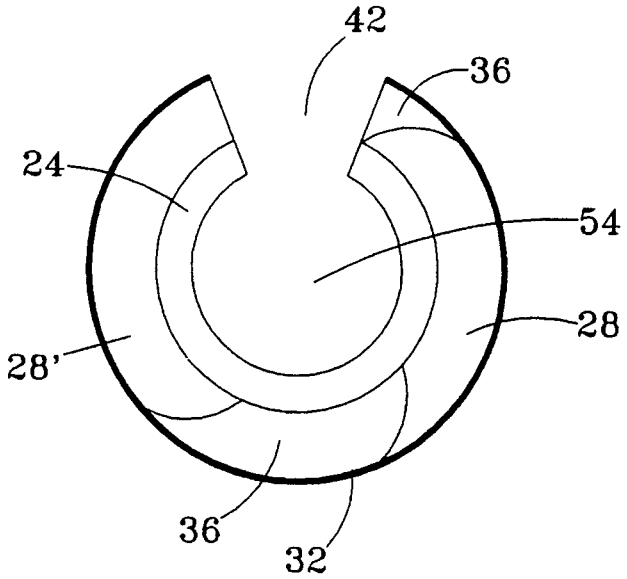
FIG. 6 is an end view of the rod guide of FIG. 5.

Referring now to FIGS. 5 and 6, there may be seen a top and side view of an alternative embodiment of the present invention having a borehole (54) and an axial slot formed throughout the length of the guide to permit the guide to be field installed. Although the slot (42) passes through the axial length of the vanes and guide body, each vane is still considered substantially continuous. A divergent tapered slot (42) may be preferred, but in some situations a parallel or even convergent slot may be desired. The borehole (54) is slightly smaller than the rod to be gripped to provide a firm engagement about the rod.

Further, this alternative embodiment illustrates the placement of two vanes (28,28'), with each of the vanes having a maximum axial width (w) of 10-30% of the selected pitch distance (P), with 20–25% more preferred. In practice an axial width of 0.8 to 1.5 inches is acceptable for a pitch distance of 5 inches. A pitch distance of 2–6 inches is more preferred, with a pitch of 2.5–3.5 most preferred. It should be noted that with a two vane guide, each vane need only have sufficient flight distance to complete 0.5–3 revolutions about the guide body, with 0.75–1 revolution being more preferred. Accordingly, a two vane guide with each vane completing 0.75 revolutions about a pitch distance of 5 inches and having an axial width of 1.25 inches produces a P/w ratio of 0.25. Likewise, a two vane guide with each vane completing 1.5 revolutions about a pitch distance of 3 inches and having an axial width of 0.75 inches also produces a P/w ratio of 0.25. In the embodiment of FIG. 5, each vane completes only about 0.75 revolutions therefore, the pitch distance is greater than the flight distance (F).

While this invention has been described in detail for the purpose of illustration, it is not construed as limited thereby but is intended to cover all changes and modifications within its spirit and scope.

We claim:

1. An improved sucker rod guide for fixedly engaging around a sucker rod at a selected location along the length of the rod, the rod guide comprising:

a substantially cylindrical polymeric body having a longitudinal axis, a radially-inward surface and a radially outward surface, the radially inward surface of the cylindrical body adjacent to and in gripping engagement with the rod when the rod guide is fixedly engaged around the rod, the cylindrical polymeric body having a body diameter (d) greater than the rod diameter of the sucker rod;

a tapered end member secured at one end of the cylindrical body, the tapered end member having an outer surface extending axially between the radially outer surface and the radially inner surface on the cylindrical body for reducing the fluid flow resistance around the rod guide; and a single, substantially continuous, helical vane carried by the cylindrical body, the vane disposed about the radially outward surface of the guide body and axially displaced along a length of the guide body a flight distance (F) sufficient for the vane to complete at least one revolution about the axis of the guide body, a revolution of the vane defined by a pitch distance (P), the vane extending radially away from the guide body and having a radially outside wear surface, the vane having a maximum width (w) at the wear surface between 30%–60% of the pitch distance (P).

2. The rod guide of claim 1 wherein the polymeric body includes an axial bore having a smaller diameter than the diameter of the sucker rod, and a slot extending longitudinally through the body and obliquely through the vane, the slot connecting the bore with the radially outside surface of the body so that the rod may be slipped through the slot and into the bore for grippingly mounting the rod guide upon the sucker rod.

3. The rod guide of claim 1 wherein the vane completes substantially between one and three revolutions about the axis of the guide body.

4. The rod guide of claim 3 wherein the vane completes substantially between one and two revolutions.

5. The rod guide of claim 1 wherein the pitch distance P is substantially 1–2 inches.

6. The rod guide of claim 5 wherein the selected pitch distance is substantially 1.4–1.6 inches.

7. The rod guide of claim 1, wherein the maximum width w of the vane is from 45–55% the pitch distance (P).

8. The rod guide as defined in claim 1, wherein the outer surface of the tapered end member has a substantially frustoconical configuration.

9. The rod guide as defined in claim 1, wherein the rod guide further includes another tapered end member at an opposing end of the cylindrical body.

10. An improved sucker rod guide for fixedly engaging around a sucker rod at a selected location along the length of the rod, the rod guide comprising:

a substantially cylindrical polymeric body having longitudinal axis, a radially inward surface and a radially outward surface, the radially inward surface of the body adjacent to and in gripping engagement with the rod when the rod guide is fixedly engaged about the rod, the cylindrical polymeric body having a body diameter (d) greater than the rod diameter of the sucker rod; and a tapered end member secured at one end of the cylindrical body, the tapered end member having an outer surface extending axially between the radially outer surface and the radially inner surface on the cylindrical body for reducing fluid flow resistance around the rod guide; and two substantially continuous helical vanes carried by the cylindrical body, each vane disposed about the radially outward surface of the guide body and axially displaced along the length of the guide body a flight distance (F) sufficient for the vane to substantially complete between 0.5 and three revolution about the axis of the guide body, a revolution of the vane defined by a pitch distance (P), the vane extending radially away from the guide body and having a radially outside wear surface, the vane having a maximum width (w) at the wear surface between 10 to 30 percent of the pitch distance (P).

11. The rod guide of claim 10 wherein a vane completes substantially 0.75–1.5 revolutions about the axis of the guide body.

12. The rod guide of claim 10 wherein the maximum width w of a vane is 20–25% the pitch distance (P).

13. The rod guide of claim 10 wherein the polymeric body includes an axial bore having a smaller diameter than the diameter of the sucker rod, and a slot extending longitudinally through the body and obliquely through the vane, the slot connecting the bore with the radially outside surface of the body so that the rod may be slipped through the slot and into the bore for grippingly mounting the rod guide upon the sucker rod.

14. The rod guide of claim 10 wherein the pitch distance P is substantially between 2–6 inches.

15. The rod guide of claim 14 wherein the pitch distance P is substantially between 2.5–3.5 inches.

16. The rod guide as defined in claim 8, wherein the outer surface of the tapered end member has a substantially frustoconical configuration.

17. The rod guide as defined in claim 10, wherein the rod guide further includes another tapered end member at an opposing end of the cylindrical body.

18. An improved sucker rod guide for fixedly engaging around a sucker rod at a selected location along a length of the rod, the rod guide comprising:

a substantially cylindrical polymeric body having a longitudinal axis, a radially-inward surface and a radially outward surface, the radially inward surface of the cylindrical body adjacent to and in gripping engagement with the rod when the rod guide is fixedly engaged around the rod, the cylindrical polymeric body having a body diameter (d) greater than the rod diameter of the sucker rod; and a single, substantially continuous, helical vane carried by the cylindrical body, the vane disposed about the radially outward surface of the guide body and axially displaced along a length of the guide body a flight distance (F) sufficient for the vane to complete at least one revolution about the axis of the guide body, a revolution of the vane defined by an axial pitch distance (P), the vane extending radially away from the guide body and having a radially outside wear surface, the axial pitch distance (P) less the axial length of the radially outer wear surface defining a void for fluid flow, the void having a cross-sectional area with a plane aligned with the longitudinal axis approximately equal to the cross-sectional area of a vane portion adjoining the void.

19. The rod guide of claim 18, wherein the polymeric body includes an axial bore having a smaller diameter than the diameter of the sucker rod; and a slot extending longitudinally through the body and obliquely through the vane, the slot connecting the bore with the radially outside surface of the body so that the rod may be slipped through the slot and into the bore for grippingly mounting the rod guide upon the sucker rod.

20. The rod guide of claim 18, wherein the vane completes substantially between one and three revolutions about the axis of the guide body.

21. The rod guide of claim 18, wherein the pitch distance (P) is substantially 1–2 inches.

22. The rod guide of claim 21, wherein the pitch distance (P) is substantially 1.4–1.6 inches.

23. An improved sucker rod guide for fixedly engaging around a sucker rod at a selected location along a length of the rod, the rod guide comprising:

a substantially cylindrical polymeric body having a longitudinal axis, a radially-inward surface and a radially outward surface, the radially inward surface of the cylindrical body adjacent to and in gripping engagement with the rod when the rod guide is fixedly engaged around the rod, the cylindrical polymeric body having a body diameter (d) greater than the rod diameter of the sucker rod; and a single, substantially continuous, helical vane carried by the cylindrical body, the vane disposed about the radially outward surface of the guide body and axially displaced along a length of the guide body a flight distance (F) sufficient for the vane to complete at least one revolution about the axis of the guide body, a revolution of the vane defined by a pitch distance (P) of from substantially 1.4 to 1.6 inches, the vane extending radially away from the guide body and having a radially outside wear surface, the vane having a maximum width (w) at the wear surface between 45% and 55% of the selected pitch distance (P).

24. The rod guide of claim 23, wherein the vane completes substantially between one and three revolutions about the axis of the guide body.

25. The rod guide of claim 24, wherein the vane completes substantially between one and two revolutions.

26. The rod guide of claim 25, wherein the polymeric body includes an axial bore having a smaller diameter than the diameter of the sucker rod; and a slot extending longitudinally through the body and obliquely through the vane, the slot connecting the bore with the radially outside surface of the body so that the rod may be slipped through the slot and into the bore for grippingly mounting the rod guide upon the sucker rod.

* * * * *